US011097537B2

(12) United States Patent
Chen et al.

(10) Patent No.: US 11,097,537 B2
(45) Date of Patent: Aug. 24, 2021

(54) FLUID EJECTION DIE MOLDED INTO MOLDED BODY

(71) Applicant: HEWLETT-PACKARD DEVELOPMENT COMPANY, L.P., Spring, TX (US)

(72) Inventors: Chien-Hua Chen, Corvallis, OR (US); Michael W Cumbie, Corvallis, OR (US); Anthony M Fuller, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/485,214

(22) PCT Filed: Apr. 24, 2017

(86) PCT No.: PCT/US2017/029213
§ 371 (c)(1),
(2) Date: Aug. 12, 2019

(87) PCT Pub. No.: WO2018/199909
PCT Pub. Date: Nov. 1, 2018

(65) Prior Publication Data

US 2020/0247123 A1 Aug. 6, 2020

(51) Int. Cl.
*B41J 2/14* (2006.01)
*B41J 2/16* (2006.01)

(52) U.S. Cl.
CPC ..... *B41J 2/14* (2013.01); *B41J 2/1637* (2013.01)

(58) Field of Classification Search
CPC ... B41J 2/14; B41J 2/1433; B41J 2/162; B41J 2/1637; B41J 2202/20; B41J 2/1603
See application file for complete search history.

(56) References Cited

U.S. PATENT DOCUMENTS 6,188,414 B1 2/2001 Wong et al.
6,524,532 B1 2/2003 Northrup
6,592,205 B2 7/2003 Beerling et al.
(Continued)

FOREIGN PATENT DOCUMENTS

CN 105189122 12/2015
CN 105377560 3/2016
(Continued)

OTHER PUBLICATIONS

Khong, C-H., et al., a Novel Method to Predict Die Shift During Compression Molding in Embedded Wafer Level Package, May 26-29, 2009< http://ieeexplore.ieee.org/abstract/docu>.

*Primary Examiner* — Justin Seo
(74) *Attorney, Agent, or Firm* — Dicke Billig & Czaja PLLC

(57) ABSTRACT

A fluid ejection device includes a molded body having a first molded surface and a second molded surface opposite the first molded surface, and a fluid ejection die molded into the molded body, with the fluid ejection die having a first surface substantially coplanar with the first molded surface of the molded body and a second surface substantially coplanar with the second molded surface of the molded body, with the first surface of the fluid ejection die having a plurality of fluid ejection orifices formed therein and the second surface of the fluid ejection die having at least one fluid feed slot formed therein.

14 Claims, 7 Drawing Sheets

(56) References Cited

U.S. PATENT DOCUMENTS

| | | | |
|---|---|---|---|
| 8,132,892 | B2 | 3/2012 | Nystrom et al. |
| 8,496,317 | B2 | 7/2013 | Ciminelli |
| 2009/0303299 | A1 | 12/2009 | Gilson et al. |
| 2010/0078407 | A1 | 4/2010 | Lebenz et al. |
| 2011/0133362 | A1 | 6/2011 | Sanada et al. |
| 2012/0210580 | A1 | 8/2012 | Dietl |
| 2016/0001551 | A1* | 1/2016 | Chen ..... B41J 2/1601 347/47 |
| 2016/0009085 | A1 | 1/2016 | Chen |
| 2016/0189986 | A1 | 6/2016 | Kasai et al. |
| 2016/0221341 | A1 | 8/2016 | Chen |

FOREIGN PATENT DOCUMENTS

| | | | |
|---|---|---|---|
| JP | 2006297753 | | 11/2006 |
| JP | 2010023340 | | 2/2010 |
| JP | 2014019128 | | 2/2014 |
| JP | 2014024230 | | 2/2014 |
| JP | 2015134495 | | 7/2015 |
| JP | 2016508460 | | 3/2016 |
| JP | 2016179544 | | 10/2016 |
| TW | 201532849 | A | 9/2015 |
| WO | WO-2014153305 | A1 | 9/2014 |
| WO | WO-2015163859 | A1 | 10/2015 |
| WO | WO-2017065728 | A1 | 4/2017 |

* cited by examiner

FLUID EJECTION DIE MOLDED INTO MOLDED BODY

BACKGROUND

A fluid ejection die, such as a printhead die in an inkjet printing system, may use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead die and the print medium move relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
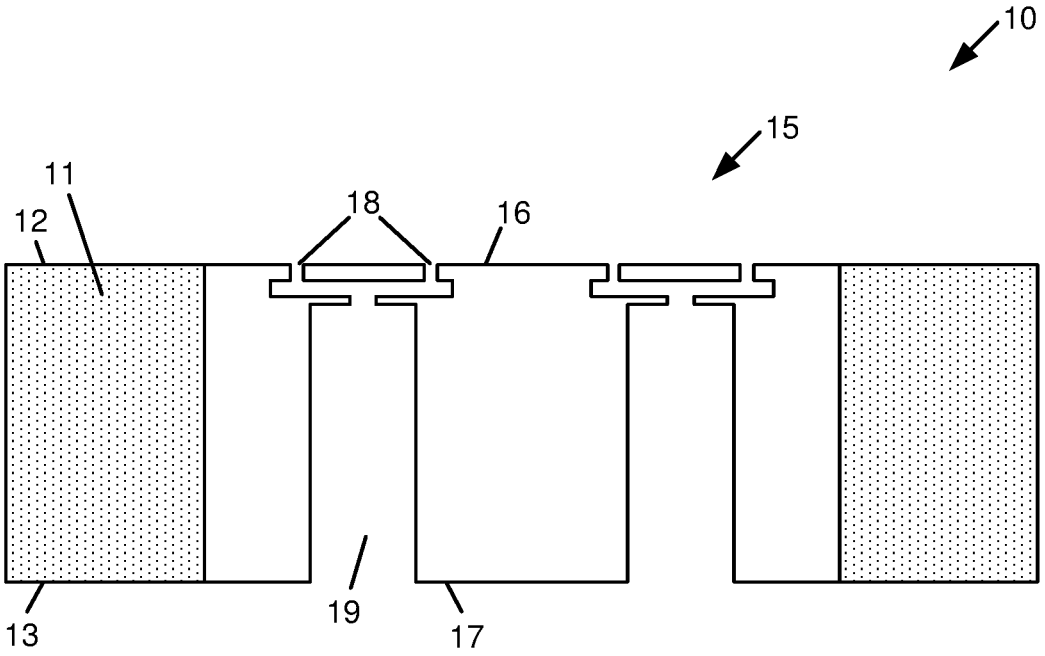
FIG. 1 is a schematic cross-sectional view illustrating an example of a fluid ejection device.

As illustrated in the example of FIG. 1, the present disclosure provides a fluid ejection device 10. In one implementation, the fluid ejection device includes a molded body 11 having a first molded surface 12 and a second molded surface 13 opposite the first molded surface, and a fluid ejection die 15 molded into the molded body, with the fluid ejection die having a first surface 16 substantially coplanar with the first molded surface of the molded body and a second surface 17 substantially coplanar with the second molded surface of the molded body, with the first surface of the fluid ejection die having a plurality of fluid ejection orifices 18 formed therein and the second surface of the fluid ejection die having at least one fluid feed slot 19 formed therein.

Figure 2:
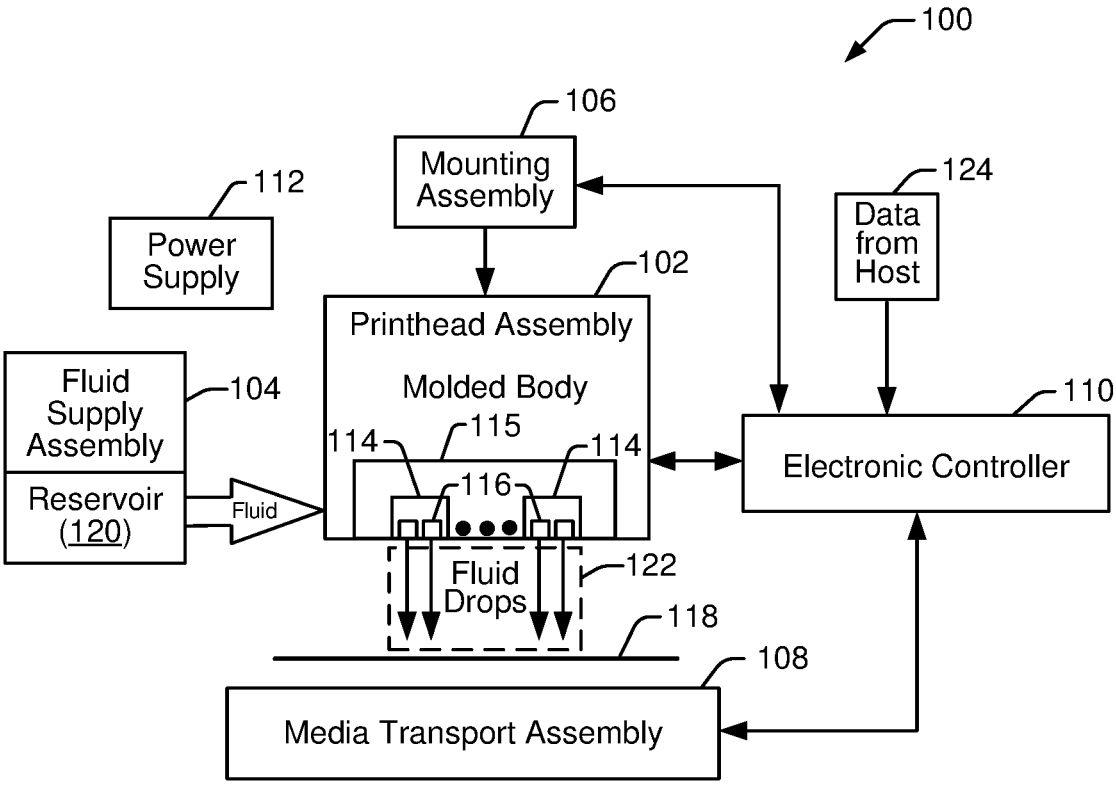
FIG. 2 is a block diagram illustrating an example of an inkjet printing system including an example of a fluid ejection device.

FIG. 2 illustrates an example of an inkjet printing system including an example of a fluid ejection device, as disclosed herein. Inkjet printing system 100 includes a printhead assembly 102, as an example of a fluid ejection assembly, a fluid (ink) supply assembly 104, a mounting assembly 106, a media transport assembly 108, an electronic controller 110, and at least one power supply 112 that provides power to the various electrical components of inkjet printing system 100. Printhead assembly 102 includes at least one printhead die 114, as an example of a fluid ejection die, that ejects drops of fluid (ink) through a plurality of orifices or nozzles 116 toward a print medium 118 so as to print on print media 118. In one implementation, one (i.e., a single) printhead die 114 or more than one (i.e., multiple) printhead die 114, as an example of a fluid ejection die, is molded into a molded body 115.

Print media 118 can be any type of suitable sheet or roll material, such as paper, card stock, transparencies, Mylar, and the like, and may include rigid or semi-rigid material, such as cardboard or other panels. Nozzles 116 are typically arranged in one or more columns or arrays such that properly sequenced ejection of fluid (ink) from nozzles 116 causes characters, symbols, and/or other graphics or images to be printed on print media 118 as printhead assembly 102 and print media 118 are moved relative to each other.

Fluid (ink) supply assembly 104 supplies fluid (ink) to printhead assembly 102 and, in one example, includes a reservoir 120 for storing fluid such that fluid flows from reservoir 120 to printhead assembly 102. Fluid (ink) supply assembly 104 and printhead assembly 102 can form a one-way fluid delivery system or a recirculating fluid delivery system. In a one-way fluid delivery system, substantially all of the fluid supplied to printhead assembly 102 is consumed during printing. In a recirculating fluid delivery system, only a portion of the fluid supplied to printhead assembly 102 is consumed during printing. Fluid not consumed during printing is returned to fluid (ink) supply assembly 104.

In one example, printhead assembly 102 and fluid (ink) supply assembly 104 are housed together in an inkjet cartridge or pen. In another example, fluid (ink) supply assembly 104 is separate from printhead assembly 102 and supplies fluid (ink) to printhead assembly 102 through an interface connection, such as a supply tube. In either example, reservoir 120 of fluid (ink) supply assembly 104 may be removed, replaced, and/or refilled. Where printhead assembly 102 and fluid (ink) supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions printhead assembly 102 relative to media transport assembly 108, and media transport assembly 108 positions print media 118 relative to printhead assembly 102. Thus, a print zone 122 is defined adjacent to nozzles 116 in an area between printhead assembly 102 and print media 118. In one example, printhead assembly 102 is a scanning type printhead assembly. As such, mounting assembly 106 includes a carriage for moving printhead assembly 102 relative to media transport assembly 108 to scan print media 118. In another example, printhead assembly 102 is a non-scanning type printhead assembly. As such, mounting assembly 106 fixes printhead assembly 102 at a prescribed position relative to media transport assembly 108. Thus, media transport assembly 108 positions print media 118 relative to printhead assembly 102.

Electronic controller 110 typically includes a processor, firmware, software, one or more memory components including volatile and non-volatile memory components, and other printer electronics for communicating with and controlling printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one example, electronic controller 110 controls printhead assembly 102 for ejection of fluid (ink) drops from nozzles 116. Thus, electronic controller 110 defines a pattern of ejected fluid (ink) drops which form characters, symbols, and/or other graphics or images on print media 118. The pattern of ejected fluid (ink) drops is determined by the print job commands and/or command parameters.

Printhead assembly 102 includes one (i.e., a single) printhead die 114 or more than one (i.e., multiple) printhead die 114. In one example, printhead assembly 102 is a wide-array or multi-head printhead assembly. In one implementation of a wide-array assembly, printhead assembly 102 includes a carrier that carries a plurality of printhead dies 114, provides electrical communication between printhead dies 114 and electronic controller 110, and provides fluidic communication between printhead dies 114 and fluid (ink) supply assembly 104.

In one example, inkjet printing system 100 is a drop-on-demand thermal inkjet printing system wherein printhead assembly 102 includes a thermal inkjet (TIJ) printhead that implements a thermal resistor as a drop ejecting element to vaporize fluid (ink) in a fluid chamber and create bubbles that force fluid (ink) drops out of nozzles 116. In another example, inkjet printing system 100 is a drop-on-demand piezoelectric inkjet printing system wherein printhead assembly 102 includes a piezoelectric inkjet (PIJ) printhead that implements a piezoelectric actuator as a drop ejecting element to generate pressure pulses that force fluid (ink) drops out of nozzles 116.

Figure 3:
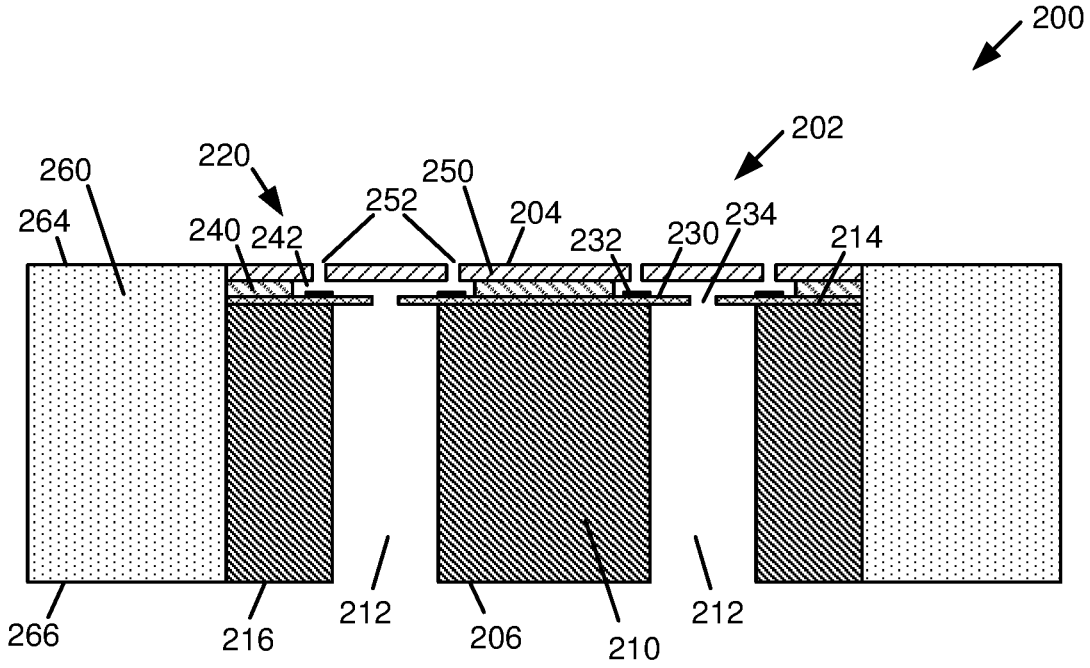
FIG. 3 is a schematic cross-sectional view illustrating an example of a fluid ejection device.

FIG. 3 is a schematic cross-sectional view illustrating an example of a fluid ejection device 200. In one implementation, fluid ejection device 200 includes a fluid ejection die 202 molded into a molded body 260, as described below.

Fluid ejection die 202 includes a substrate 210 and a fluid architecture 220 supported by substrate 210. In the illustrated example, substrate 210 has two fluid (or ink) feed slots 212 formed therein. Fluid feed slots 212 provide a supply of fluid (such as ink) to fluid architecture 220 such that fluid architecture 220 facilitates the ejection of fluid (or ink) drops from fluid ejection die 202. While two fluid feed slots 212 are illustrated, a greater or lesser number of fluid feed slots may be used in different implementations.

Substrate 210 has a first or front-side surface 214 and a second or back-side surface 216 opposite front-side surface 214 such that fluid flows through fluid feed slots 212 and, therefore, through substrate 210 from the back side to the front side. Accordingly, in one implementation, fluid feed slots 212 communicate fluid (or ink) with fluid architecture 220 through substrate 210.

In one example, substrate 210 is formed of silicon and, in some implementations, may comprise a crystalline substrate such as doped or non-doped monocrystalline silicon or doped or non-doped polycrystalline silicon. Other examples of suitable substrates include gallium arsenide, gallium phosphide, indium phosphide, glass, silica, ceramics, or a semiconducting material.

As illustrated in the example of FIG. 3, fluid architecture 220 is formed on or provided on front-side surface 214 of substrate 210. In one implementation, fluid architecture 220 includes a thin-film structure 230 formed on or provided on front-side surface 214 of substrate 210, a barrier layer 240 formed on or provided on thin-film structure 230, and an orifice layer 250 formed on or provided on barrier layer 240. As such, orifice layer 250 (with orifices 252 therein) provides a first or front-side surface 204 of fluid ejection die 202, and substrate 210 (with fluid feed slots 212 therein) provides a second or back-side surface 206 of fluid ejection die 202.

In one example, thin-film structure 230 includes one or more than one passivation or insulation layer formed, for example, of silicon dioxide, silicon carbide, silicon nitride, tantalum, poly-silicon glass, or other material, and a conductive layer which defines drop ejecting elements 232 and corresponding conductive paths and leads. The conductive layer is formed, for example, of aluminum, gold, tantalum, tantalum-aluminum, or other metal or metal alloy. In one example, thin-film structure 230 has one or more than one fluid (or ink) feed hole 234 formed therethrough which communicates with fluid feed slot 212 of substrate 210.

Examples of drop ejecting elements 232 include thermal resistors or piezoelectric actuators, as described above. A variety of other devices, however, can also be used to implement drop ejecting elements 232 including, for example, a mechanical/impact driven membrane, an electrostatic (MEMS) membrane, a voice coil, a magnetostrictive drive, and others.

In one example, barrier layer 240 defines a plurality of fluid ejection chambers 242 each containing a respective drop ejecting element 232 and communicated with fluid feed hole 234 of thin-film structure 230. Barrier layer 240 includes one or more than one layer of material and may be formed, for example, of a photoimageable epoxy resin, such as SU8.

In one example, orifice layer 250 is formed or extended over barrier layer 240 and has nozzle openings or orifices 252, as examples of fluid ejection orifices, formed therein. Orifices 252 communicate with respective fluid ejection chambers 242 such that drops of fluid are ejected through respective orifices 252 by respective drop ejecting elements 232.

Orifice layer 250 includes one or more than one layer of material and may be formed, for example, of a photoimageable epoxy resin, such as SU8, or a nickel substrate. In some implementations, orifice layer 250 and barrier layer 240 are the same material and, in some implementations, orifice layer 250 and barrier layer 240 may be integral.

As illustrated in the example of FIG. 3, molded body 260 includes a molded surface 264 and a molded surface 266 opposite molded surface 264. As described below, molded body 260 is molded such that molded surface 264 is substantially coplanar with front-side surface 204 of fluid ejection die 202 and molded surface 266 is substantially coplanar with back-side surface 206 of fluid ejection die 202. As such, a molded thickness of molded body 260 (without additional processing of molded body 260 after molding) is substantially the same as a thickness of fluid ejection die 202. Molded body 260 includes, for example, an epoxy mold compound, plastic, or other suitable moldable material.

Figure 4A:
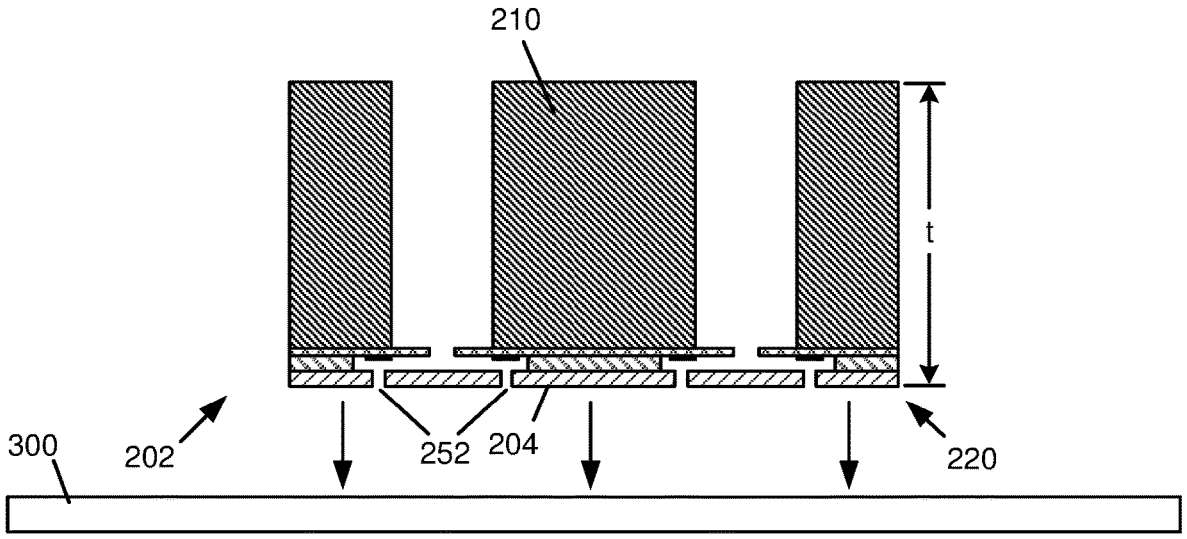
FIGS. 4A, 4B, 4C, 4D schematically illustrate an example of forming a fluid ejection device.

FIGS. 4A, 4B, 4C, 4D schematically illustrate an example of forming fluid ejection device 200. In one example, as illustrated in FIG. 4A, fluid ejection die 202 (with fluid architecture 220 provided on substrate 210) is positioned on a die carrier 300. More specifically, fluid ejection die 202 is positioned on die carrier 300 with front-side surface 204 facing die carrier 300, as indicated by the direction arrows. As such, orifices 252 face die carrier 300. In one implementation, a thermal release tape (not shown) is provided on a surface of die carrier 300 before fluid ejection die 202 is positioned on die carrier 300.

Figure 4B:
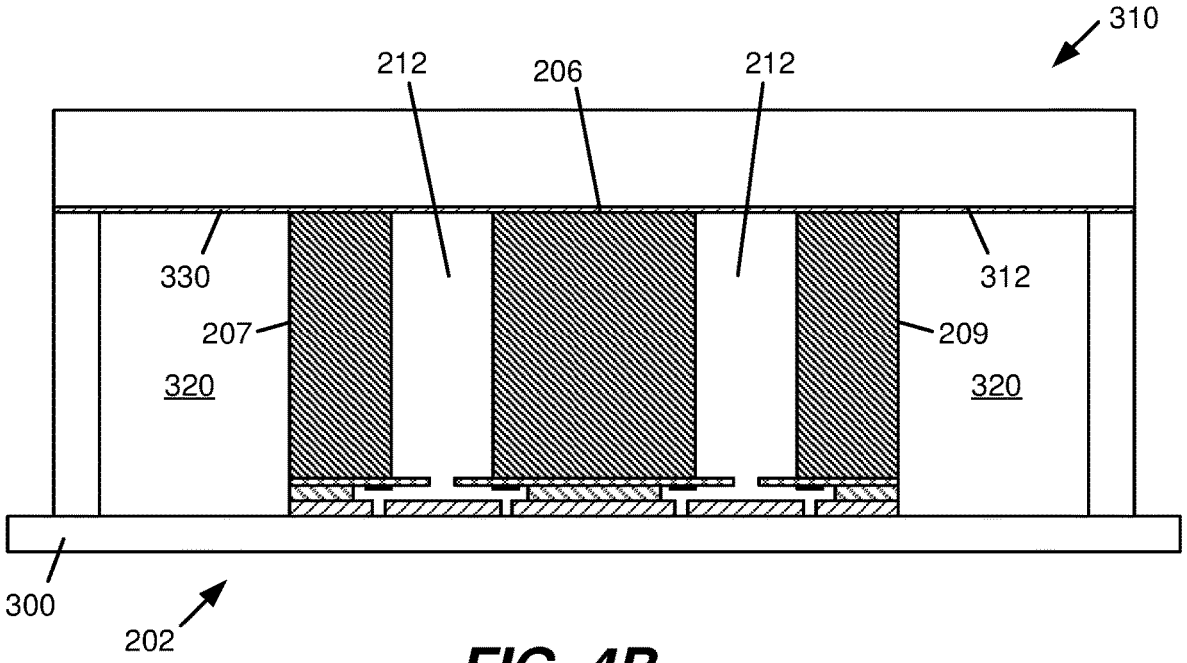

As illustrated in the example of FIG. 4B, with fluid ejection die 202 positioned on die carrier 300, an upper mold chase 310 is positioned over fluid ejection die 202 (and die carrier 300). More specifically, upper mold chase 310 is positioned over fluid ejection die 202 with back-side surface 206 of fluid ejection die 202 facing upper mold chase 310. As such, upper mold chase 310 seals fluid feed slots 212 (as formed in substrate 210 and communicated with back-side surface 206) to protect fluid feed slots 212 during molding of molded body 260. In one implementation, upper mold chase 310 includes a substantially planar surface 312 which extends over fluid feed slots 212 and beyond opposite edges (for example, edges 207 and 209) of fluid ejection die 202 to seal fluid feed slots 212 and create cavities 320 between upper mold chase 310 and die carrier 300 around and along opposite edges (for example, edges 207 and 209) of fluid ejection die 202.

In one example, a release liner 330 is positioned along surface 312 of upper mold chase 310 so as to be positioned between fluid ejection die 202 and upper mold chase 310. Release liner 330 helps to prevent contamination of upper mold chase 310 and minimize flash during the molding process.

Figure 4C:
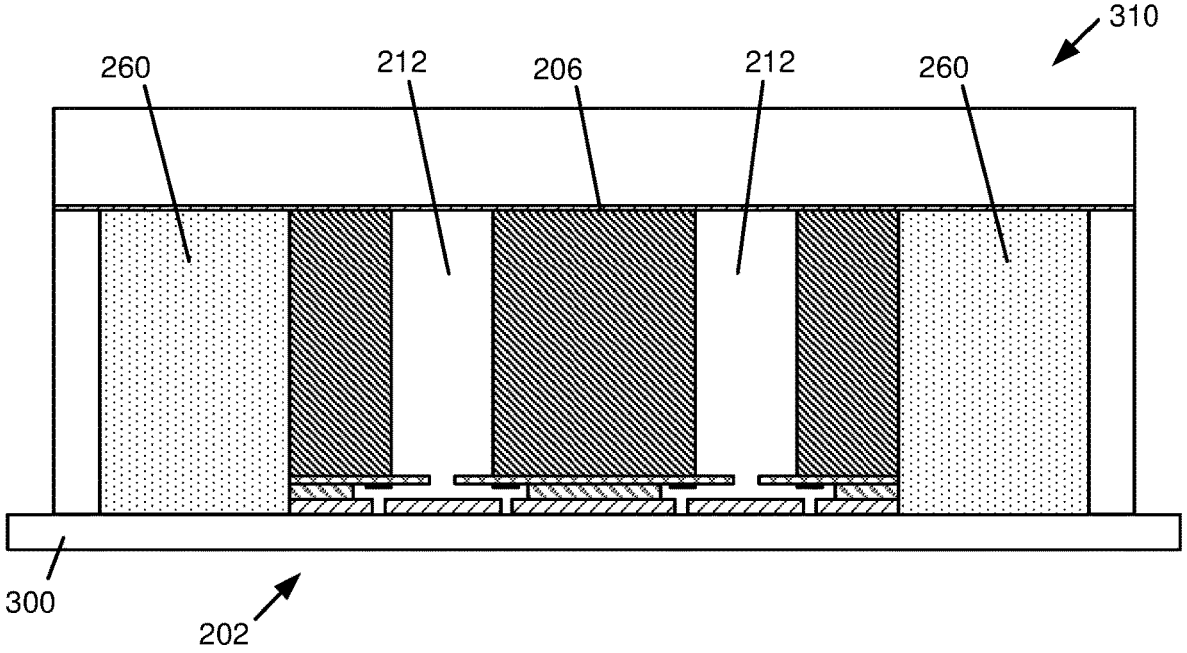

As illustrated in the example of FIG. 4C, cavities 320 are filled with mold material, such as an epoxy mold compound, plastic, or other suitable moldable material. Filling cavities 320 with mold material forms molded body 260 around fluid ejection die 202. In one example, the molding process is a transfer molding process and includes heating the mold material to a liquid form and injecting or vacuum feeding the liquid mold material into cavities 320 (for example, through runners communicated with cavities 320). As such, upper mold chase 310 (as positioned along back-side surface 206 of fluid ejection die 202) helps to prevent the mold material from entering fluid feed slots 212 as cavities 320 are filled.

Figure 4D:
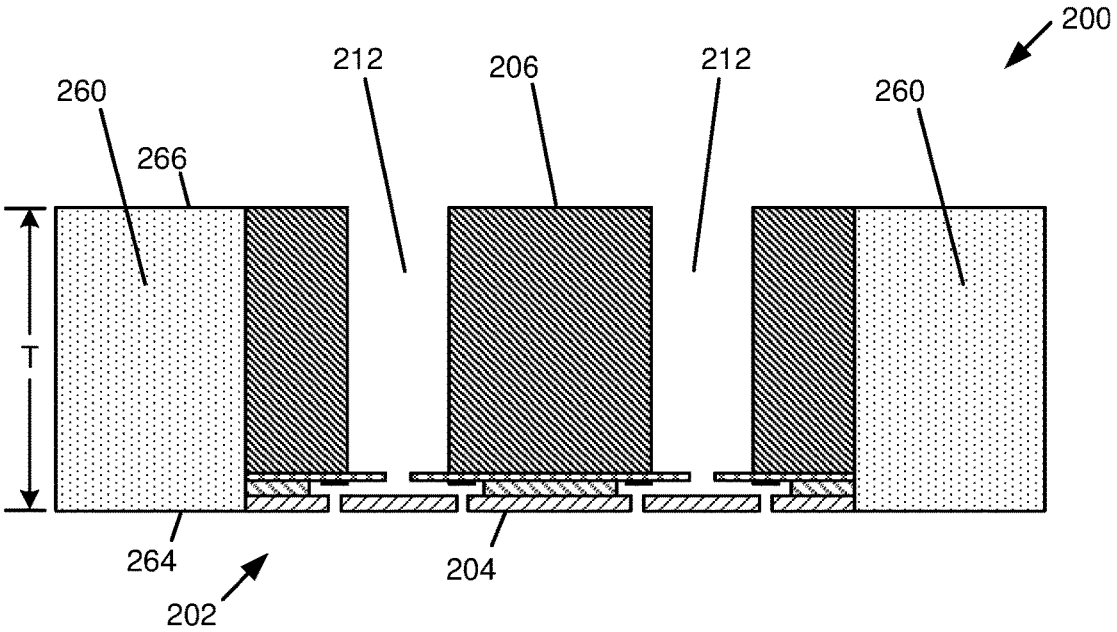

In one example, as illustrated in FIG. 4D, after the mold material cools and hardens to a solid, upper mold chase 310 and die carrier 300 are separated, and fluid ejection die 202, as molded into molded body 260, is removed or released from die carrier 300. Thus, molded body 260 is molded to include molded surface 264 and molded surface 266, with molded surface 264 substantially coplanar with front-side surface 204 of fluid ejection die 202 and molded surface 266 substantially coplanar with back-side surface 206 of fluid ejection die 202. As such, and without additional processing to molded surface 264 or molded surface 266, a molded thickness T of molded body 260 is substantially equal to a thickness t (FIG. 4A) of fluid ejection die 202. In addition, front-side surface 204 of fluid ejection die 202 and back-side surface 206 of fluid ejection die 202 both remain exposed from molded body 260 (i.e., are not covered by mold material of molded body 260).

Figure 5:
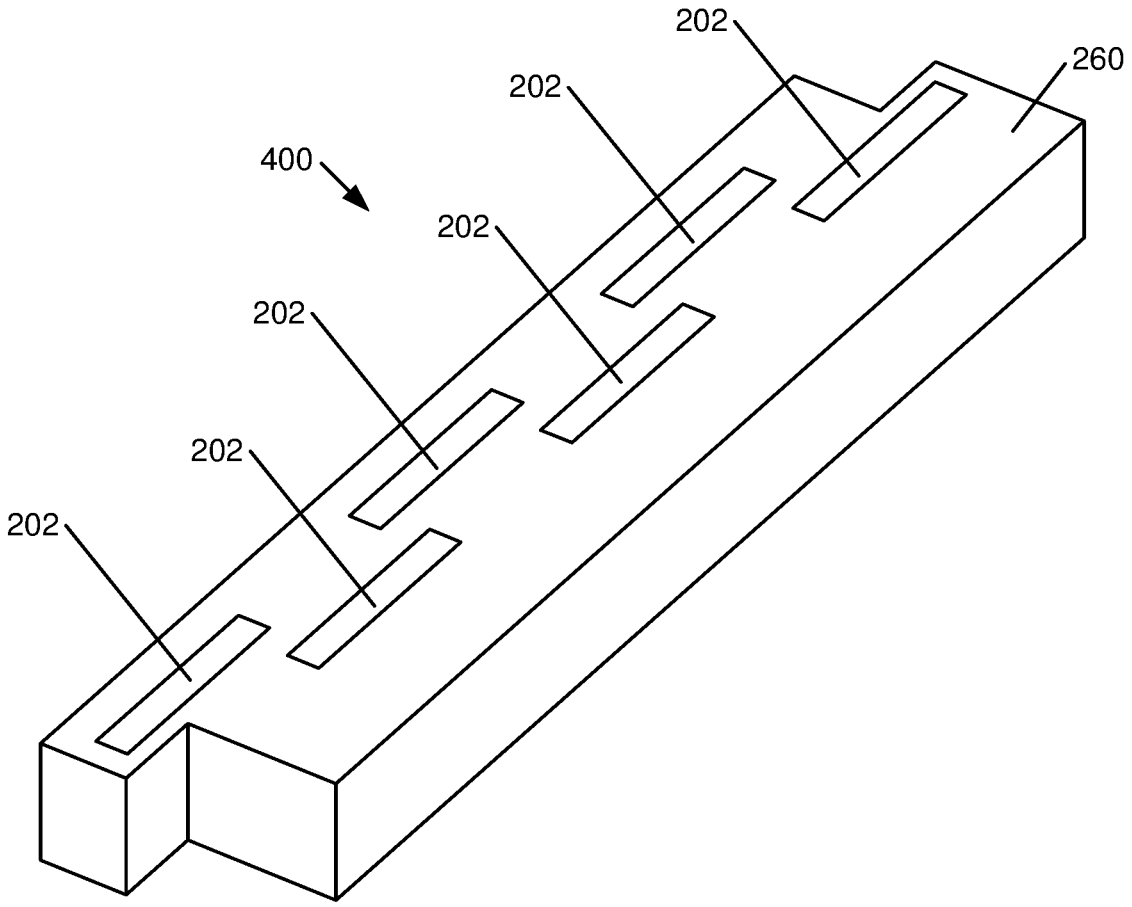
FIG. 5 is a schematic perspective view illustrating an example of a fluid ejection device including multiple fluid ejection dies.

While one fluid ejection die 202 is illustrated in FIGS. 4A, 4B, 4C, 4D as being molded into molded body 260, a greater number of fluid ejection dies 202 may be molded into molded body 260. For example, as illustrated in FIG. 5, six fluid ejection dies 202 are molded into molded body 260 to form a fluid ejection device 400 as a monolithic molded body with multiple fluid ejection dies 202. In one implementation, fluid ejection device 400 is a wide-array or multi-head printhead assembly with fluid ejection dies 202 arranged and aligned in one or more overlapping rows such that fluid ejection dies 202 in one row overlap at least one fluid ejection die 202 in another row. As such, fluid ejection device 400 may span a nominal page width or a width shorter or longer than a nominal page width. For example, the printhead assembly may span 8.5 inches of a Letter size print medium or a distance greater than or less than 8.5 inches of the Letter size print medium. While six fluid ejection dies 202 are illustrated as being molded into molded body 260, the number of fluid ejection dies 202 molded into molded body 260 may vary.

Figure 6:
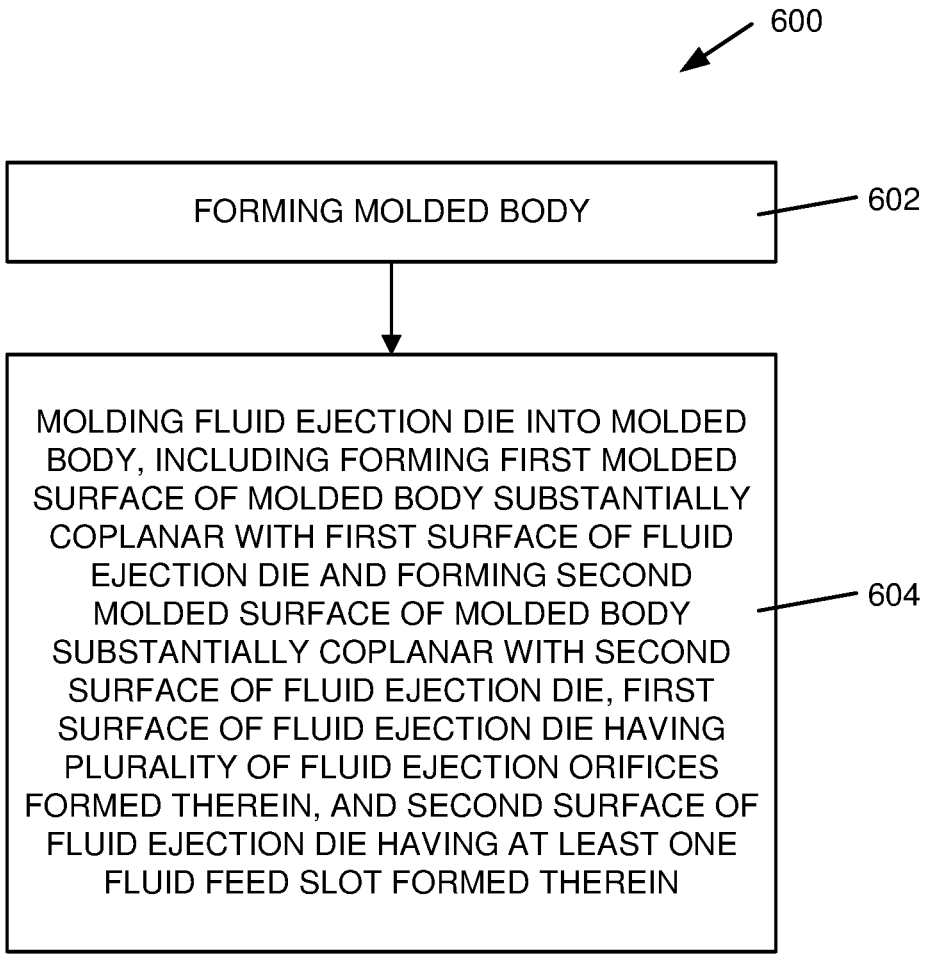
FIG. 6 is a flow diagram illustrating an example of a method of forming a fluid ejection device.

FIG. 6 is a flow diagram illustrating an example of a method 600 of forming a fluid ejection device, such as fluid ejection devices 200, 400 as illustrated in the respective examples of FIGS. 3, 4A-4D, 5. At 602, method 600 includes forming a molded body, such as molded body 260. And, at 604, method 600 includes molding a fluid ejection die into the molded body, such as fluid ejection die(s) 202 molded into molded body 260.

In one example, molding a fluid ejection die into the molded body, at 604, includes forming a first molded surface of the molded body substantially coplanar with a first surface of the fluid ejection die, such as molded surface 264 of molded body 260 substantially coplanar with front-side surface 204 of fluid ejection die 202, and forming a second molded surface of the molded body substantially coplanar with a second surface of the fluid ejection die, such as molded surface 266 of molded body 260 substantially coplanar with back-side surface 206 of fluid ejection die 202, with the first surface of the fluid ejection die having a plurality of fluid ejection orifices formed therein, such as orifices 252 formed in front-side surface 204 of fluid ejection die 202, and the second surface of the fluid ejection die having at least one fluid feed slot formed therein, such as fluid feed slot 212 formed in back-side surface 206 of fluid ejection die 202.

As disclosed herein, fluid ejection die are molded into a molded body, such as fluid ejection die 202 molded into molded body 260. Molding fluid ejection die into a molded body helps improve heat sinking of the fluid ejection die. In addition, molding multiple fluid ejection die into a molded body, as disclosed herein, results in a coplanar multi-die fluid ejection device.

Example fluid ejection devices, as described herein, may be implemented in printing devices, such as two-dimensional printers and/or three-dimensional printers (3D). As will be appreciated, some example fluid ejection devices may be printheads. In some examples, a fluid ejection device may be implemented into a printing device and may be utilized to print content onto a media, such as paper, a layer of powder-based build material, reactive devices (such as lab-on-a-chip devices), etc. Example fluid ejection devices include ink-based ejection devices, digital titration devices, 3D printing devices, pharmaceutical dispensation devices, lab-on-chip devices, fluidic diagnostic circuits, and/or other such devices in which amounts of fluids may be dispensed/ejected.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. A fluid ejection device, comprising:

a molded body having a maximum molded thickness and including a first molded surface at the maximum molded thickness and a second molded surface at the maximum molded thickness opposite the first molded surface; and a fluid ejection die molded into the molded body, the fluid ejection die having a thickness and including a first surface coplanar with the first molded surface of the molded body and a second surface coplanar with the second molded surface of the molded body, the first surface of the fluid ejection die having a plurality of fluid ejection orifices formed therein and the second surface of the fluid ejection die having at least one fluid feed slot formed therein, the maximum molded thickness of the molded body being equal to the thickness of the fluid ejection die.

2. The fluid ejection device of claim 1, wherein the fluid ejection die includes a substrate and a fluid architecture supported by the substrate, the substrate comprising the second surface of the fluid ejection die and having the at least one fluid feed slot formed therein, and the fluid architecture providing the first surface of the fluid ejection die and including the plurality of fluid ejection orifices.

3. The fluid ejection device of claim 2, wherein the fluid architecture includes a plurality of fluid ejection chambers each communicated with a respective one of the fluid ejection orifices and having a respective drop ejecting element therein.

4. The fluid ejection device of claim 2, wherein the fluid architecture includes an orifice layer having the plurality of fluid ejection orifices formed therein, the orifice layer comprising the first surface of the fluid ejection die.

5. The fluid ejection device of claim 1, wherein the substrate comprises a silicon substrate, and the molded body comprises an epoxy mold compound.

6. The fluid ejection device of claim 1, wherein the fluid ejection die comprises a plurality of fluid ejection dies molded into the molded body, each of the fluid ejection dies having the first surface coplanar with the first molded surface of the molded body and the second surface coplanar with the second molded surface of the molded body.

7. A fluid ejection device, comprising:

a fluid ejection die having a thickness from a first surface to a second surface, the first surface having a plurality of fluid ejection orifices formed therein and the second surface having at least one fluid feed slot formed therein; and a molded body molded around the fluid ejection die, the first surface of the fluid ejection die and the second surface of the fluid ejection die both exposed from the molded body, and a maximum molded thickness of the molded body being the same as the thickness of the fluid ejection die, wherein the molded body has a first molded surface at the maximum molded thickness coplanar with the first surface of the fluid ejection die and a second molded surface at the maximum molded thickness opposite the first molded surface coplanar with the second surface of the fluid ejection die.

8. The fluid ejection device of claim 7, wherein the fluid ejection die includes a substrate and a fluid architecture supported by the substrate, the substrate comprising the second surface of the fluid ejection die and having the at least one fluid feed slot formed therein, and the fluid architecture providing the first surface of the fluid ejection die and including the plurality of fluid ejection orifices.

9. The fluid ejection device of claim 7, wherein the substrate comprises a silicon substrate, and the molded body comprises an epoxy mold compound.

10. A method of forming a fluid ejection device, comprising:

forming a molded body; and molding a fluid ejection die into the molded body, including forming the molded body with a maximum molded thickness, forming a first molded surface of the molded body at the maximum molded thickness coplanar with a first surface of the fluid ejection die and forming a second molded surface of the molded body at the maximum molded thickness coplanar with a second surface of the fluid ejection die, the first surface of the fluid ejection die having a plurality of fluid ejection orifices formed therein, the second surface of the fluid ejection die having at least one fluid feed slot formed therein, the fluid ejection die having a thickness from the first surface to the second surface, and the maximum molded thickness of the molded body being equal to the thickness of the fluid ejection die.

11. The method of claim 10, wherein molding the fluid ejection die into the molded body includes positioning the fluid ejection die on a carrier with the first surface of the fluid ejection die facing the carrier, and positioning an upper mold chase over the fluid ejection die with the second surface of the fluid ejection die facing the upper mold chase.

12. The method of claim 11, wherein positioning the upper mold chase over the fluid ejection die includes positioning a substantially planar surface of the upper mold chase over the at least one fluid feed slot and beyond opposite edges of the fluid ejection die.

13. The method of claim 11, further comprising:

positioning a release liner between the second surface of the fluid ejection die and the upper mold chase.

14. The method of claim 10, wherein the fluid ejection die includes a substrate and a fluid architecture supported by the substrate, the substrate comprising the second surface of the fluid ejection die and having the at least one fluid feed slot formed therein, and the fluid architecture providing the first surface of the fluid ejection die and including the plurality of fluid ejection orifices.

* * * * *